US005630643A

United States Patent [19]

Scholten et al.

[11] Patent Number: 5,630,643

[45] Date of Patent: May 20, 1997

[54] UPHOLSTERED CHAIR WITH TWO-PIECE SHELL

[76] Inventors: Brian L. Scholten, 8525 Beretta Ct., Jenison, Mich. 49428; James E. Abraham, 3460 Navaho SW., Grandville, Mich. 49418; Dale M. Groendal, 2528 PineWood St., Jenison, Mich. 49428; Robert M. Scheper, 25 Wallinwood NE., Grand Rapids, Mich. 49503; Thomas R. Hahn, 4727 Southstone SE., Kentwood, Mich. 49548; Douglas A. Smith, 943 Oakhurst NW., Grand Rapids, Mich. 49504

[21] Appl. No.: 71,391

[22] Filed: Jun. 1, 1993

[51] Int. Cl.[6] ..... A47C 7/00; A47C 31/02

[52] U.S. Cl. ..... 297/218.2; 297/452.59; 297/440.15; 297/440.16; 297/228.13

[58] Field of Search ..... 297/218.2, 228.13, 297/452.59, 452.6, 440.11, 440.15, 440.16

[56] References Cited

U.S. PATENT DOCUMENTS

| | | | |
|---|---|---|---|
| 4,082 | 10/1983 | Adomeit et al. . | |
| Re. 24,587 | 1/1959 | Thaden . | |
| Re. 29,522 | 1/1978 | Barecki . | |
| 110,887 | 7/1871 | Tracey . | |
| D. 144,719 | 5/1946 | King et al. . | |
| D. 167,607 | 9/1952 | Becker . | |
| D. 285,629 | 9/1986 | Franck et al. . | |
| 357,388 | 2/1887 | Hunzinger . | |
| 422,431 | 3/1890 | McCrudden . | |
| 856,850 | 6/1907 | Dobe . | |
| 1,189,995 | 7/1916 | Olson . | |
| 1,263,162 | 4/1918 | Travers . | |
| 1,491,918 | 4/1924 | Nolan . | |
| 1,692,252 | 11/1928 | Eichman . | |
| 1,912,282 | 5/1933 | Krebs . | |
| 2,130,781 | 9/1938 | Willoughby . | |
| 2,264,143 | 11/1941 | Scott et al. . | |
| 2,324,318 | 7/1943 | Niedringhaus . | |
| 2,365,200 | 12/1944 | Lorenz . | |
| 2,480,552 | 8/1949 | Colvez . | |
| 2,597,105 | 5/1952 | Julian . | |
| 2,658,555 | 11/1953 | Barker . | |
| 2,706,518 | 4/1955 | Fleischer . | |
| 2,710,647 | 6/1955 | Dorton . | |
| 2,745,468 | 5/1956 | Kramer . | |
| 2,837,144 | 6/1958 | Heller | 297/218 |
| 2,853,125 | 9/1958 | Starke . | |
| 3,006,685 | 10/1961 | Ewert . | |
| 3,140,118 | 7/1964 | Dorn . | |
| 3,146,028 | 8/1964 | Grosfillex . | |

(List continued on next page.)

FOREIGN PATENT DOCUMENTS

| | | | |
|---|---|---|---|
| 3839456 | 5/1990 | Germany | 297/218 |
| 89729 | 8/1957 | Norway | 297/440.15 |

*Primary Examiner*—Timothy Thorpe
*Assistant Examiner*—Roland G. McAndrews, Jr.
*Attorney, Agent, or Firm*—Price, Heneveld, Cooper, DeWitt & Litton

[57] ABSTRACT

A chair includes a base, a chair control and tilt mechanism, a shell assembly and a cushion assembly. The shell assembly includes a seat shell fixed to the base and a separate back shell. The back shell and seat shell are interconnected by a mechanical hinge. The hinge includes a pair of tabs on the back shell received in sockets defined by the seat shell. The tabs are retained in the sockets by the chair base. Back supports or chair arms have ends operatively connected to the tilt mechanism. Opposite ends of the arms are secured to the seat back to support and guide the back during tilting movement. The cushion assembly includes a molded foam member having a fabric or other upholstery material joined thereto. The back shell includes an integral, hinged upholstery flap. The fabric of the cushion assembly is folded over and joined to the flap. The flap is folded and operatively connected to a rear surface of the back shell. The seat shell includes another integral upholstery attachment flap. The flaps provide a finished edge for the upholstery. The back shell defines grooves within which lateral edges of the cushion assembly upholstery material are retained.

69 Claims, 6 Drawing Sheets

U.S. PATENT DOCUMENTS

| | | | |
|---|---|---|---|
| 3,167,352 | 1/1965 | Johnson . | |
| 3,174,797 | 3/1965 | Neufeld . | |
| 3,273,178 | 9/1966 | Baruth et al. . | |
| 3,298,743 | 1/1967 | Albinson et al. . | |
| 3,357,740 | 12/1967 | Vaughn et al. . | |
| 3,589,772 | 6/1971 | Leaver . | |
| 3,632,150 | 1/1972 | Milakovich . | |
| 3,640,576 | 2/1972 | Morrison et al. . | |
| 3,658,382 | 4/1972 | Anderson | 297/440.15 |
| 3,669,495 | 6/1972 | Von Rudgisch . | |
| 3,669,499 | 6/1972 | Semplonius et al. . | |
| 3,743,352 | 7/1973 | Kallander . | |
| 3,752,533 | 8/1973 | Gilbert . | |
| 3,758,159 | 9/1973 | Morris | 297/452.59 |
| 3,778,102 | 12/1973 | Snyder et al. . | |
| 3,797,887 | 3/1974 | Barecki et al. . | |
| 3,841,704 | 10/1974 | Platner et al. . | |
| 3,873,155 | 3/1975 | Barecki . | |
| 3,874,727 | 4/1975 | Mehbert et al. . | |
| 3,874,729 | 4/1975 | Blodee . | |
| 3,883,257 | 5/1975 | Delafield . | |
| 3,907,363 | 9/1975 | Baker et al. . | |
| 4,019,776 | 4/1977 | Takamatsu . | |
| 4,040,665 | 8/1977 | Wallace et al. . | |
| 4,057,291 | 11/1977 | Dubinsky . | |
| 4,065,182 | 12/1977 | Braniff et al. . | |
| 4,099,774 | 7/1978 | Sandham . | |
| 4,131,315 | 12/1978 | Vogtherr . | |
| 4,152,023 | 5/1979 | Buhk . | |
| 4,157,203 | 6/1979 | Ambasz . | |
| 4,159,146 | 6/1979 | Braconnier et al. . | |
| 4,265,483 | 5/1981 | Raftery et al. . | |
| 4,270,797 | 6/1981 | Brauning . | |
| 4,304,436 | 12/1981 | Rowland . | |
| 4,352,524 | 10/1982 | Crosby . | |
| 4,359,245 | 11/1982 | Franke . | |
| 4,370,002 | 1/1983 | Koepke . | |
| 4,390,206 | 6/1983 | Faiks et al. . | |
| 4,390,210 | 6/1983 | Wisniewski et al. . | |
| 4,396,226 | 8/1983 | Haack | 297/452.59 |
| 4,408,797 | 10/1983 | Franck et al. . | |
| 4,408,802 | 10/1983 | Adomeit et al. . | |
| 4,438,898 | 3/1984 | Knoblauch et al. . | |
| 4,451,085 | 5/1984 | Franck et al. . | |
| 4,479,679 | 10/1984 | Fries et al. . | |
| 4,494,795 | 1/1985 | Roossien et al. . | |
| 4,498,702 | 2/1985 | Raftery . | |
| 4,522,444 | 6/1985 | Pollock . | |
| 4,527,832 | 7/1985 | McMains et al. . | |
| 4,557,521 | 12/1985 | Lange | 297/286 |
| 4,588,227 | 5/1986 | Austin . | |
| 4,603,904 | 8/1986 | Tolleson et al. . | |
| 4,685,730 | 8/1987 | Linguanotto . | |
| 4,717,195 | 1/1988 | Okuyama et al. . | |
| 4,718,153 | 1/1988 | Armitage et al. . | |
| 4,744,603 | 5/1988 | Knoblock . | |
| 4,754,529 | 7/1988 | Paradis . | |
| 4,768,905 | 9/1988 | Reynard . | |
| 4,776,633 | 10/1988 | Knoblock et al. . | |
| 4,789,201 | 12/1988 | Selbert . | |
| 4,790,596 | 12/1988 | Shifferaw . | |
| 4,792,189 | 12/1988 | Shovar . | |
| 4,819,986 | 4/1989 | Markus . | |
| 4,830,435 | 5/1989 | Nemschoff et al. . | |
| 4,840,426 | 6/1989 | Vogtherr et al. . | |
| 4,844,546 | 7/1989 | Hanai . | |
| 4,861,104 | 8/1989 | Malak . | |
| 4,867,507 | 9/1989 | Arai . | |
| 4,880,273 | 11/1989 | Markus . | |
| 4,889,385 | 12/1989 | Chadwick et al. | 297/286 |
| 4,890,883 | 1/1990 | Boerema et al. . | |
| 4,900,090 | 2/1990 | Davis . | |
| 4,911,501 | 3/1990 | Decker et al. . | |
| 4,917,931 | 4/1990 | McDowell et al. . | |
| 4,971,394 | 11/1990 | Vanderminden . | |
| 4,979,778 | 12/1990 | Shields . | |
| 4,988,145 | 1/1991 | Engel . | |
| 5,015,038 | 5/1991 | Mrotz, III . | |
| 5,023,125 | 6/1991 | Gray . | |
| 5,026,117 | 6/1991 | Faiks et al. . | |
| 5,028,472 | 7/1991 | Gray . | |
| 5,042,876 | 8/1991 | Faiks . | |
| 5,046,780 | 9/1991 | Decker et al. . | |
| 5,061,539 | 10/1991 | McDowell et al. . | |
| 5,067,772 | 11/1991 | Koa . | |
| 5,067,773 | 11/1991 | Koa . | |
| 5,069,496 | 12/1991 | Kunh et al. . | |
| 5,074,621 | 12/1991 | McDonald | 297/440.15 |
| 5,100,201 | 3/1992 | Becker, III et al. . | |
| 5,102,196 | 4/1992 | Kaneda et al. . | |
| 5,110,186 | 5/1992 | Clark et al. . | |
| 5,168,615 | 12/1992 | Koa . | |
| 5,195,801 | 3/1993 | Franck et al. . | |

UPHOLSTERED CHAIR WITH TWO-PIECE SHELL

BACKGROUND OF THE INVENTION

The present invention relates to furniture and, more particularly, to a chair adapted for use in the office environment.

Many different types of office chairs are presently available. Such chairs are adapted to a wide variety of tasks and different users. An office chair may include a base structure having a height adjustable pedestal mounted on a caster assembly for easy movement. A tilt or chair control mechanism may be supported on the base, and the back of the chair may tilt with respect to the base. Chairs are also provided which include a fixed base or nontiltable support structure. Side chairs, for example, may include a so-called sled-base.

Examples of prior office chairs may be found in commonly owned U.S. Pat. No. 4,390,206 entitled SYCHRO-TILT CHAIR CONTROL, which issued on Jun. 28, 1984 to Faiks et al; commonly owned U.S. Pat. No. 4,494,795 entitled VARIABLE BACK ADJUSTER FOR CHAIRS, which issued on Jan. 22, 1985 to Roossien and commonly owned U.S. Pat. No. 4,744,603 entitled CHAIR SHELL WITH SELECTIVE BACK STIFFENING, which issued on May 17, 1988 to Knoblock.

Prior office chairs have included a one-piece shell which defines both the seat portion and the back portion of the chair. The shell supports the user and is a structural member. The structural shell is, however, flexible so that the seat back portion may tilt or pivot with respect to the seat portion. Various steps are taken in forming the shell to provide the desired strength and tilting action. Since the shell is a one-piece member, force is needed to deform or bend the seat back with respect to the seat portion. This force must be accommodated when designing the chair in order to achieve a particularly desired ride or feel in use. Typical chair controls or tilt mechanisms include an axle connected to a pair of back uprights. The uprights and axle are biased to an upright or first position by a torsion spring. The uprights are moved to a reclined position against the increase in force generated by the torsion spring. The back portion of the one-piece shell is mounted on or secured to the vertical uprights of the chair control mechanism. In such chairs, a cushion assembly and upholstery are secured to the front surface of the shell. The upholstery material is pulled around the edges of the shell and secured to the back surface of the shell by staples or other suitable means. A decorative, non-load bearing outer shell is attached to the inner shell to enclose the back tilt mechanism and the unfinished edges of the upholstery material.

Various problems are presented with current office chair constructions. Difficulties are presented with molding the chair shell as an integral one-piece member including a back portion and seat portion. Existing tilt mechanisms including the back uprights and existing upholstery methods necessitate the use of the outer decorative shells or covers. The cover increases the thickness of the side profile of the chair and, hence, has an effect on the chair aesthetics and cost.

A need exists for an office chair which is readily adaptable to use with a tilt mechanism and which eliminates, however, the outer decorative shells or covers and the need for the vertical uprights to support the shell back. In addition, a need exists for a chair incorporating an upholstery and cushion assembly integrated with the chair shell to provide a finished appearance while eliminating the need for a decorative outer shell or cover.

SUMMARY OF THE INVENTION

In accordance with the present invention, the aforementioned needs are met. Essentially, a chair is provided including a base which supports a shell and cushion assembly. In one aspect of the invention, a seat shell is fixed to the base. A separate back shell is mechanically connected to the seat shell through a hinge structure. The separate shell construction eliminates problems heretofore experienced with fabricating the chair shell as a one-piece member defining both the back and seat portions. In addition, the seat shell and back shell may be fabricated from different plastic materials and in different colors.

In further aspects of the invention, the back shell is supported for movement between a fully upright and fully reclined position by a tilt mechanism. The tilt mechanism includes side support members which may define the arms for the chair. The support members are secured at one end to the tilt mechanism and biased to an upright position. Opposite ends of the support members are secured to the back shell intermediate the ends of the shell. The arms provide structural support for the shell and guide the back shell through the full range of tilt action.

In still further aspects of the present invention, a chair cushion assembly includes a molded foam member covered by an upholstery material such as a fabric. The back shell is formed with an integral attachment flap adjacent an upper edge thereof. The unfinished or frayed edges of the upholstery material are folded over the attachment flap and joined thereto. The attachment flap is then folded against the back surface of the back shell and secured thereto to form a finished edge. In further aspects, the back shell defines channels which extend along the lateral edges thereof. An elongated flexible retention member retains the upholstery in the channel along the lateral edges of the chair. A decorative trim strip may be included to cover the channel.

In accordance with the present invention, a chair is provided which may incorporate a tilt mechanism while eliminating the cost of back uprights heretofore used as well as eliminating the need for a separate decorative, non-load bearing cover or outer shell. The chair may be provided in an upholstered version with the upholstery material and cushion assembly readily attached thereto. The back shell may function as a visible outer chair surface. Problems heretofore experienced with mold tooling draw angles and the like resulting from the shape of the one-piece, L-shaped chair shells are eliminated. Molding separate seat and back shells which are mechanically interconnected by a hinge structure also eliminates the energy in the hinge area thereby improving the ride of the chair. A chair incorporating features of the present invention may be manufactured at reduced cost when compared to prior chairs while retaining desired functional advantages. The reduced profile of the chair in accordance with the present invention is aesthetically pleasing. The basic chair construction, including the upholstery and cushion assembly, back shell and seat shell, is adaptable to fixed base, sled base and tilt base mechanisms.

DETAILED DESCRIPTION OF THE PREFERRED EMBODIMENT

Figure 1:
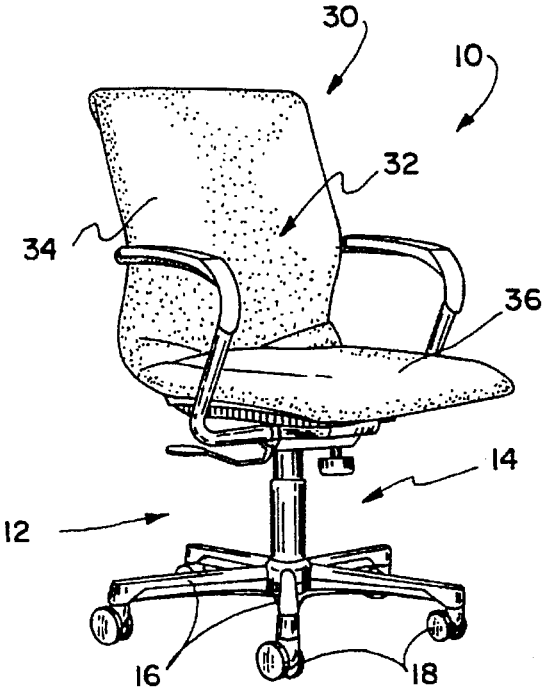
FIG. 1 is a front, perspective view of an office chair in accordance with the present invention.
Figure 2:
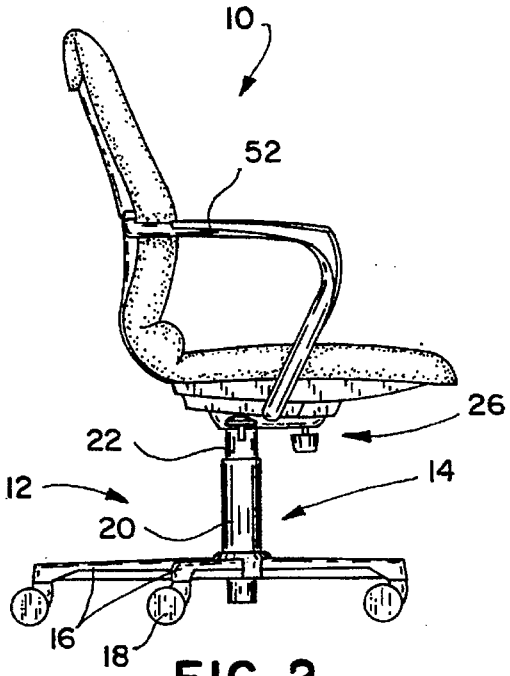
FIG. 2 is a side, elevational view thereof.

A chair in accordance with the present invention is illustrated in FIGS. 1–5 and generally designated by the numeral 10. Chair 10 includes a base 12 having a pedestal 14, arms 16 and casters 18. In the embodiment illustrated, pedestal 14 includes a lower tube 20 which telescopingly receives a height adjustable tube 22. A chair control 26, which includes a tilt mechanism, as described in detail below, is secured to tube 22 of base 12. A shell and cushion assembly 30 defining a front surface 32 is mounted on base 12. Assembly 30 includes a configured back portion 34 and a configured seat portion 36. In the alternative, base 12 could take the form of a fixed base structure without the tilt chair control 26. In addition, assembly 30 could be attached to a sled-base arrangement, as is known in the art.

Chair control 26 includes a housing 42 which is fixed to pedestal tube 22. A pan or chair strap 44 is fixed to housing 42. Housing 42 and pan 44 are fixed with respect to ground. A conventional torsion spring assembly 46 is mounted within housing 42. Assembly 46 includes an axle 48 and coil springs 50. Springs 50 each include an end secured to housing 42 and another end fixed to the axle assembly 46. In accordance with the present invention, support members 52 are secured to the tilt mechanism 46. In the form illustrated in FIGS. 1–4, support members 52 define the arms for the chair. The arms include upper armrest portions 54, a lower inturned end 56 and an upper inturned end 58. End 56 includes a generally circular attachment flange 60. Flange 60 is bolted or otherwise suitably secured to axle 48. Tilt mechanism 46, therefore, resiliently biases the supports or arms 52 to an upright position as illustrated in FIGS. 1, 2, 3 and 5. Ends 58 of the arms 52 are formed with flattened attachment bracket portions 64. Portions 64 are secured to a rear surface of assembly 30. Portions 64 are enclosed by suitable trim caps 68. Suitable arm caps 70 are secured to armrest supports 52. Armrests 52, therefore, form structural members for the chair. The armrests support back portion 32 of assembly 30 and resiliently bias portion 32 to an upright position. As described in more detail below, assembly 30 includes structure permitting back portion 32 to pivot with respect to seat portion 36 and, hence, with respect to base 12. Seat portion 36 of assembly 30 is fixed to pan 44 and, hence, base 42 by suitable fasteners. A decorative cover 72 (FIGS. 4 and 5) is attached to an undersurface of seat portion 36 of assembly 30 to enclose or cover the structural portions of a control housing 42 and pan or strap 44.

Figure 5:
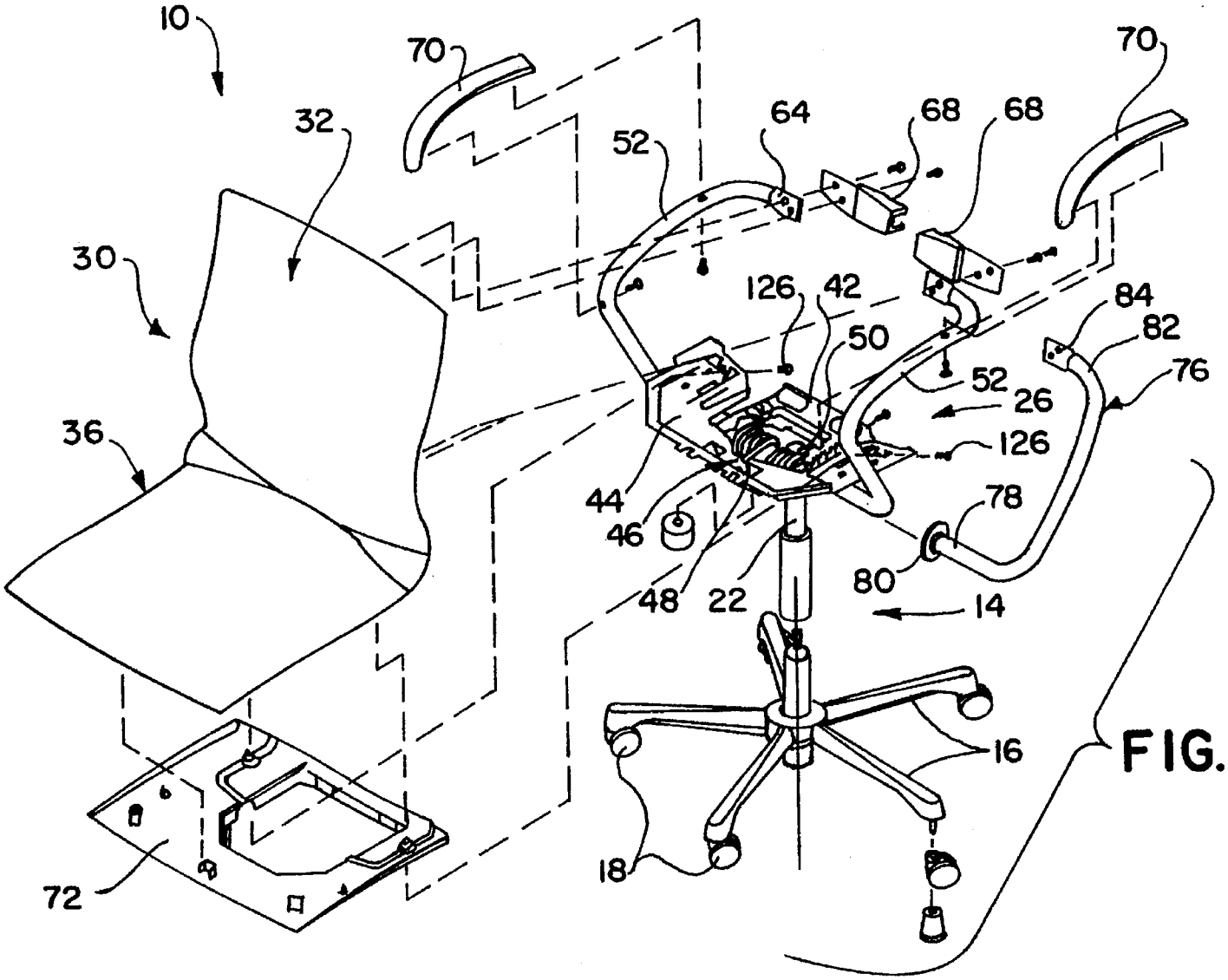
FIG. 5 is an exploded, assembly view of a chair in accordance with the present invention.

An alternative, armless version is also illustrated in FIG. 5, wherein generally U-shaped supports 76 are provided for both right and left sides of the chair. U-shaped supports 76 replace support members 52. The supports 76 each include a lower end 78 having an integral attachment flange 80 and an upper end 82 including the back portion attachment bracket 84. Support members 76 function as structural supports supporting back portion 32 of assembly 30 and permitting tilt action of portion 32 with respect to seat portion 36.

Figure 8:
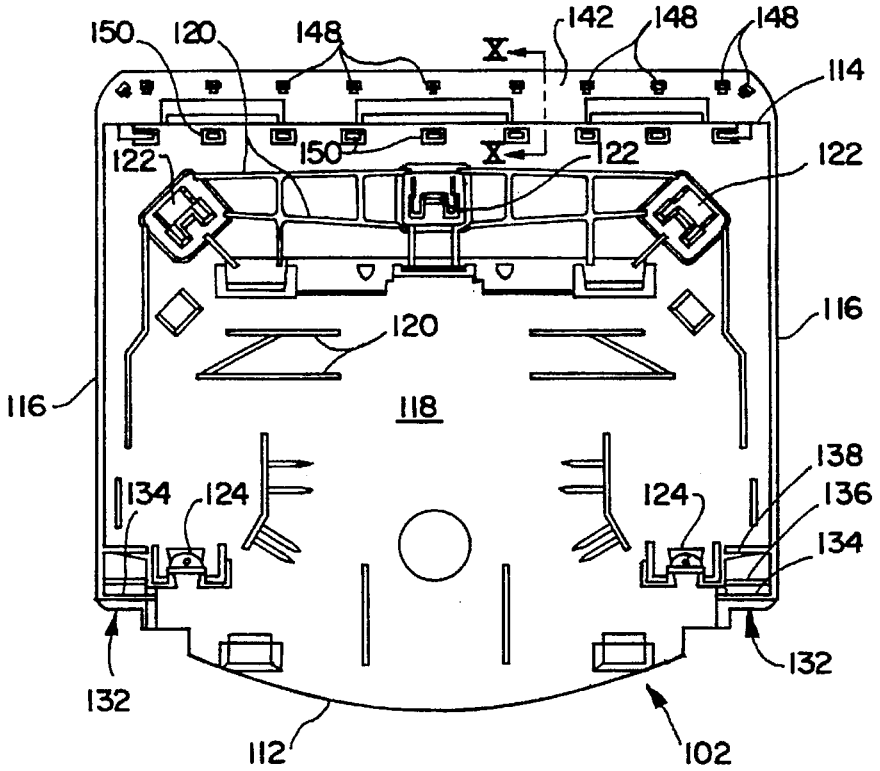
FIG. 8 is a bottom, plan view of a seat shell incorporated in the present invention.
Figure 9:
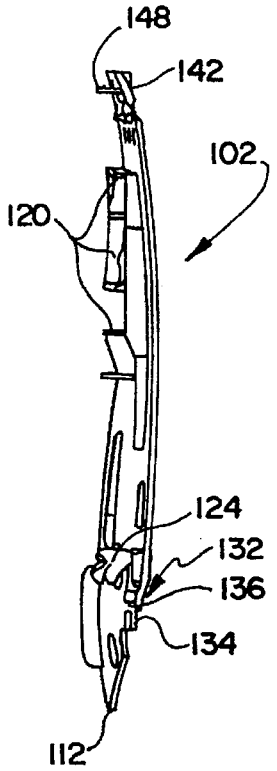
FIG. 9 is a side view of the shell of FIG. 8.
Figure 10:
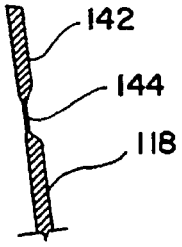
FIG. 10 is a cross-sectional view taken generally along line X—X of FIG. 8.

Assembly 30 in accordance with the present invention includes a seat shell 102, a back shell 104 and a cushion and upholstery subassembly 106. Seat shell 102, as seen in FIGS. 8–10, is a molded structural plastic member. Shell 102 includes a rear edge 112, a forward edge portion 114, lateral sides 116 and a main body portion 118. The undersurface of portion 118 of shell 102 includes suitable reinforcing ribbing 120 to provide structural rigidity. Shell 102 further defines attachment bosses 122 and 124. Seat shell 102 is secured to seat strap 44 at bosses 122 and 124. Suitable fasteners 126 are threaded through pan 44 and into bosses 124. Socket structures 132 (FIGS. 8 and 14) are also defined by seat shell 102 adjacent lateral edges 116 at rear edge 112 thereof. Sockets 132 include a strap 134 formed integral with shell 102 and spaced downwardly therefrom to define an aperture 136. The undersurface of body portion 118 at sockets 132 also defines a stop 138. As described in more detail below, sockets 132 are used to interconnect back shell 104 with seat shell 102.

An upholstery attachment flap 142 is molded integrally with shell 102 along front edge 114. Attachment flap 142 is joined to main body portion 118 of shell 102 along an integral, living hinge 144. Hinge 144 extends transversely between lateral edges 116 of shell 102. Flap 142 is formed with integral snaps 148. As explained in more detail below, flap 142 may be folded about hinge 144 towards bottom surface 118 of shell 102. Snaps 148 are snapped into snap apertures 150.

Figure 3:
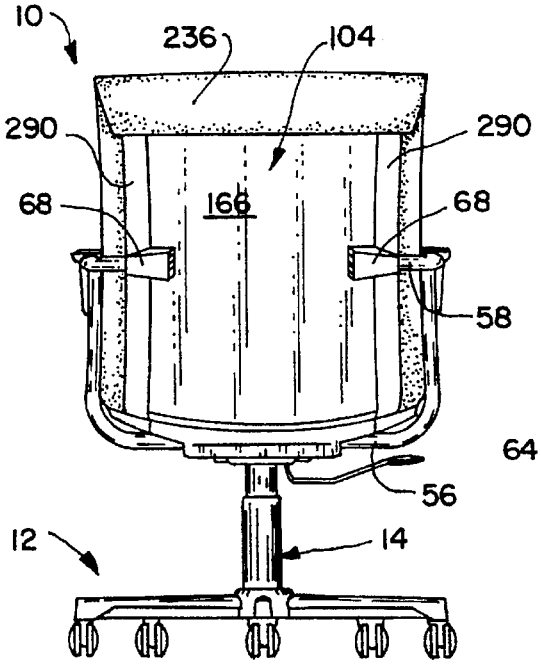
FIG. 3 is a rear, elevational view thereof.
Figure 13:
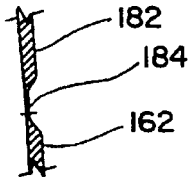
FIG. 13 is a fragmentary, side view taken generally along line XIII—XIII of FIG. 11.
Figure 12:
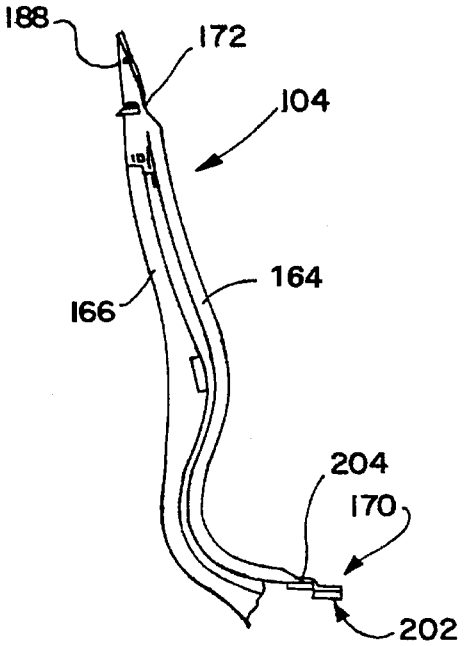
FIG. 12 is a side, elevational view of the back shell of FIG. 11.
Figure 11:
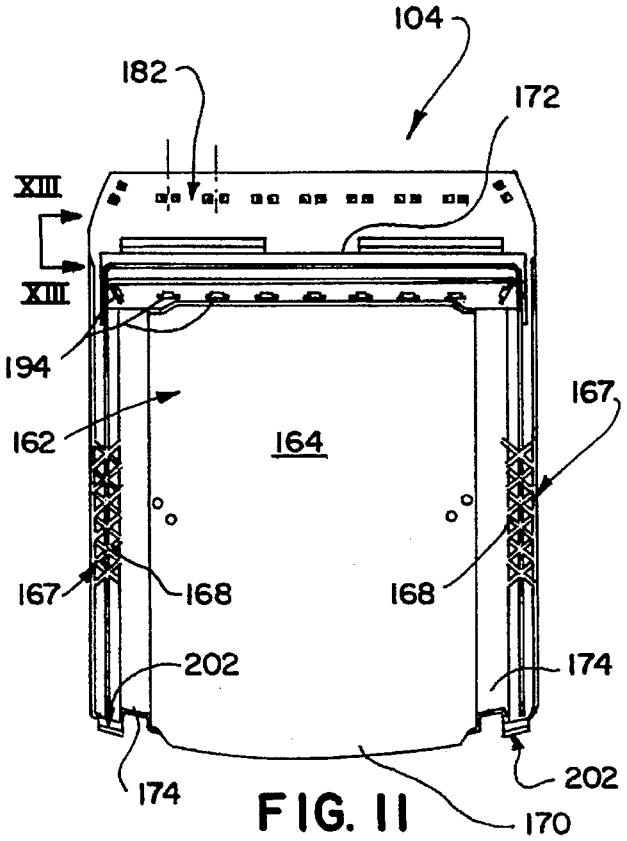
FIG. 11 is a front, elevational view of a back shell incorporated in the present invention.

Separate back shell 104 is best seen in FIGS. 11, 12 and 13. As shown therein, shell 104 includes a main body portion 162 having a front surface 164 and a rear surface 166. As seen in FIG. 3, rear surface 166 is exposed to view. The surface may be formed with a textured molded surface for aesthetic reasons. In the alternative, a fabric could be glued to the surface. Shell 104 includes lateral edges 167 having structural ribbing 168, a front or lower edge portion 170 and an upper edge portion 172. Shell 104 further defines longitudinally extending channels 174. Channels 174 extend parallel to lateral edges 167 of shell 104. The channels 174 open through rear surface 166 of the shell.

Figure 19:
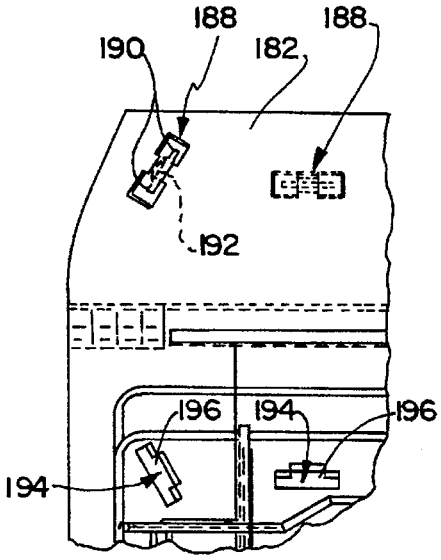
FIG. 19 is an enlarged, fragmentary, front view of an upper portion of the back shell in accordance with the present invention.
Figure 18:
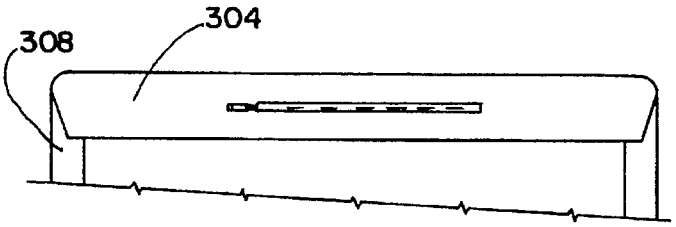
FIG. 18 is a fragmentary view taken generally along line XVIII—XVIII of FIG. 15.

An upholstery attachment flap 182 is formed integral with upper edge portion 172 of shell 104. Flap 182 is joined to the main body portion 162 of the shell along an integral living hinge 184. Flap 182, as described in detail below, is foldable rearwardly against rear surface 166 of shell 102. Flap 182 is formed with integral, generally T-shaped snaps 188. As seen in FIG. 19, snaps 188 include wings 190 joined to a central stem portion 192. The T-shaped snaps 188 are dimensioned to be received and retained within a configured slot 194 formed on main body portion 162. Slot 194 includes a stem receiving portion 196.

The lower or front edge portion 170 of shell 104 is formed with a pair of outwardly extending attachment tabs 202. Tabs 202 are generally L-shaped in side elevation. Each tab 202 is hingedly joined to body portion 162 at a living hinge 204. As seen in the enlarged view of FIG. 14, tab 202 includes a first end portion 206, a generally vertical transition portion 208 and a second generally horizontal portion 210 which is joined to the main body portion. Attachment tabs 202 are molded integral with shell 104 at the outer lateral edges 167 thereof.

Fabricating the seat shell and back shell as separate pieces eliminates problems heretofore experienced with molding an integral one-piece shell. Separating the shell into two separate pieces improves the draw angle of the tooling allowing for better molding conditions. The shells may be molded in different colors. The seat shell, for example, which would be enclosed or not visible may be molded without color pigmentation. The back shell may be molded in any desired color for aesthetic reasons since the rear surface thereof is visible in use.

Figure 14:
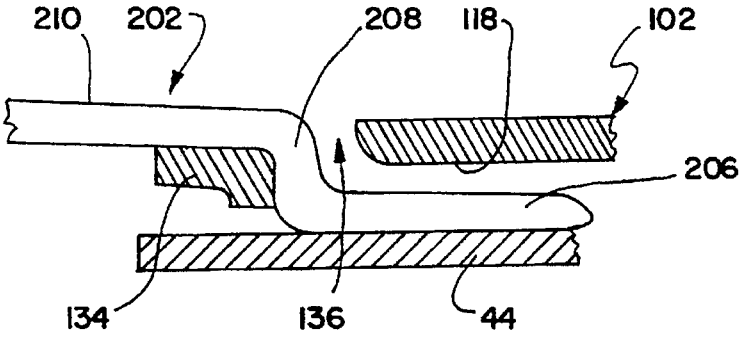
FIG. 14 is an enlarged, fragmentary, cross-sectional view illustrating the interconnection between the back shell and seat shell.
Figure 15:
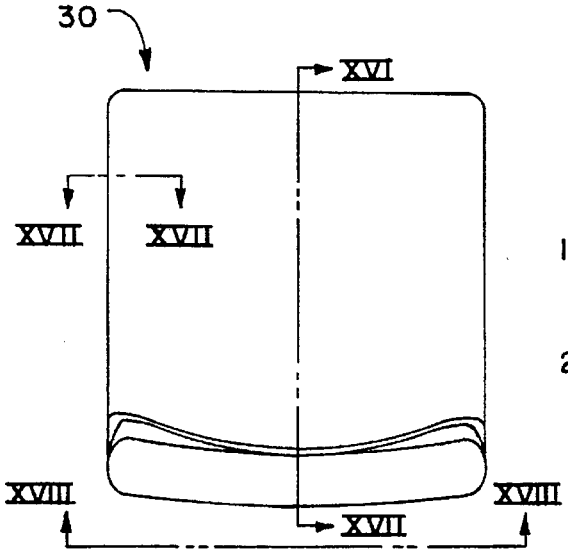
FIG. 15 is a front, elevational view of the shell and cushion assembly in accordance with the present invention.

Shell 104 is easily attached to shell 102 by slipping attachment tabs 202 through the attachment apertures 136 formed in the seat shell 102. When shell 102 is fixed to the base 12 at strap 44, the strap, as seen in FIG. 14, engages attachment tab 202. Tab 202 is captured within the socket 134. The tab is sandwiched between the undersurface of shell 102 and the upper surface of pan or strap 44. Attachment strap 134 of shell 102 prevents rearward movement or withdrawal of attachment tab 202 since it engages the generally vertical transition portion 208 thereof. The tab is captured in the socket. The separate shell pieces are easily interconnected without the need for separate fasteners. The simple hinge connection between the tabs 202 and the shell main body portion eliminates the energy at the zone between the back shell and the seat shell. This elimination of energy improves the ride or feel of the chair as it moves from a fully upright to a fully reclined position.

The upholstery and cushion subassembly incorporated in the present invention is best seen in FIGS. 15, 16, 17 and 20. As shown therein, the assembly includes an inner molded foam component 232, a foam sheet 234 and an outer upholstery material 236. Upholstery material 236 may be any suitable fabric, leather or other covering material. The upholstery and cushion subassembly is preferably fabricated as a unit with the foam, foam sheet and upholstery bonded together.

It is presently preferred that the molded foam and cushion assembly be fabricated in accordance with the process disclosed in commonly owned U.S. Pat. No. 4,718,153 entitled CUSHION MANUFACTURING PROCESS, which issued on Jan. 12, 1988 to Armitage et al. To the extent necessary, this patent is hereby incorporated by reference. The process disclosed therein molds an upholstered chair cushion by placing a sheet of the upholstering material between two dies. Foam material is also positioned between the dies which are moved towards each other to compress the foam in the die cavities to force the upholstery material and foam to conform to the shape of the dies. The foam and upholstery are coated with an air permeable adhesive. Hot vapors are injected into the cavity to shape the foam cushion material and upholstery material generally to the sculpted configuration of the die.

Figure 17:
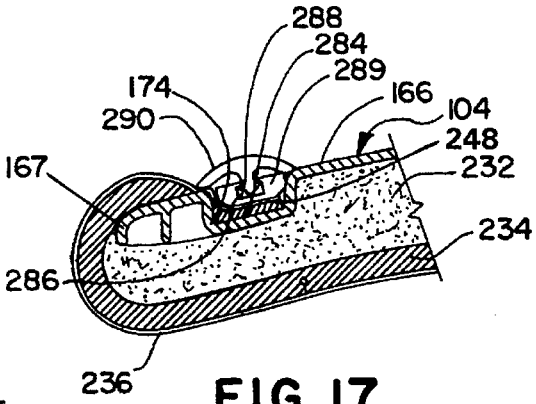
FIG. 17 is a cross-sectional view taken generally along line XVII—XVII of FIG. 15.
Figure 16:
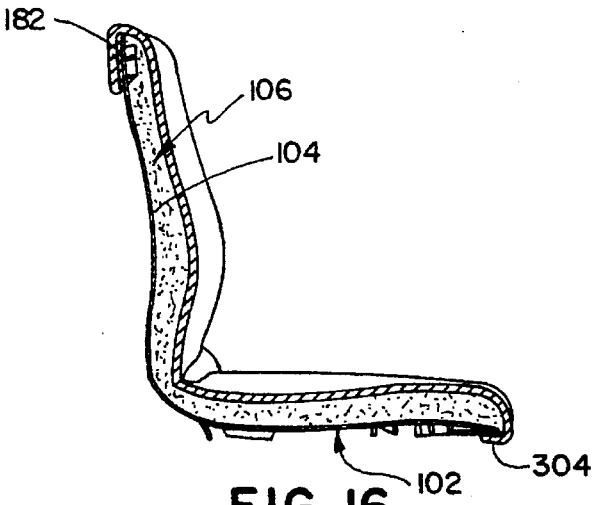
FIG. 16 is a cross-sectional view taken generally along line XVI—XVI of FIG. 15.
Figure 20:
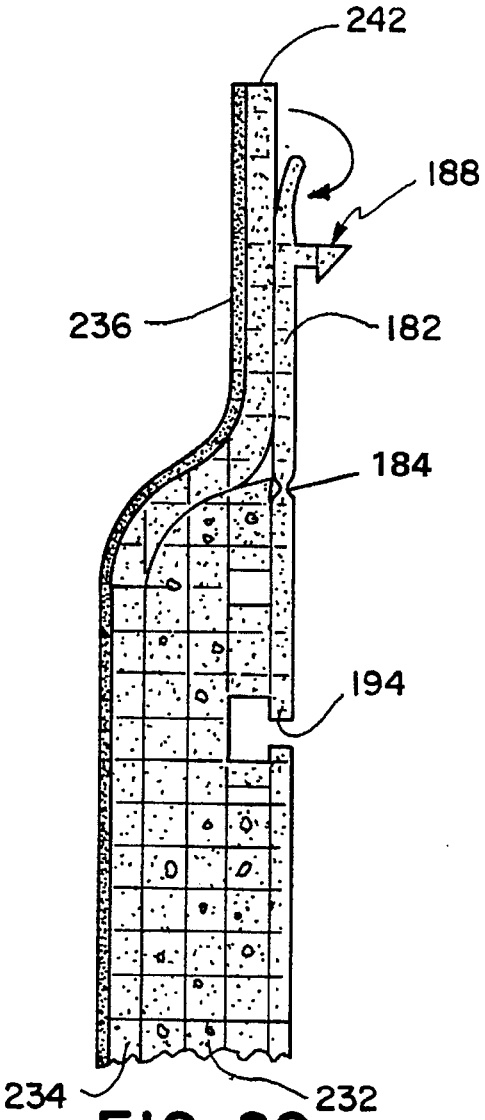
FIGS. 20, 21 and 22 are fragmentary, cross-sectional views showing the method of attachment of an upholstery and cushion subassembly to the back shell.
Figure 21:
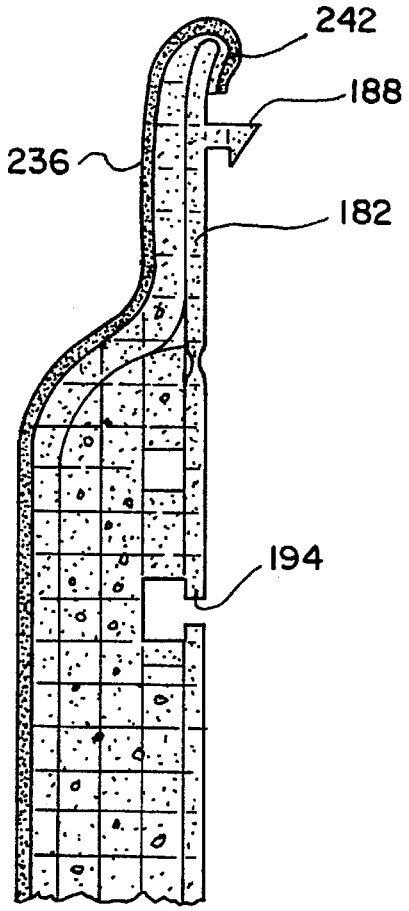
Figure 22:
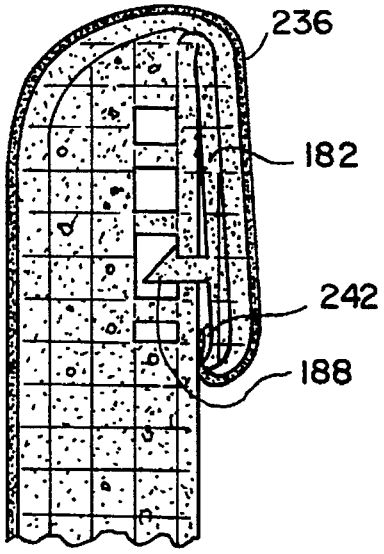

The cushion subassembly in accordance with the present invention and as illustrated, for example, in FIGS. 16, 17 and 20 is formed with unfinished edges 242. Edge 242 may be frayed from cutting of the fabric or upholstery material. Edge 242 is attached to the shell assembly including back shell 104 and seat shell 102 by folding the edge over and onto fabric attachment flap 182 of shell 104. The unfinished edge 242 is attached to the rear surface of flap 182 by an adhesive or by suitable staples. As shown in FIGS. 21 and 22, flap 182 is then folded downwardly about integral hinge 184 until the snap fasteners 188 are received in apertures 194. The upholstery material 236 will be pulled over upper edge 172 of the back shell. The frayed edges of the fabric are hidden between flap 182 and a rear surface of the shell. As seen in FIG. 3, the attachment flap provides a finished appearance for the upholstery.

Prior to folding flap 182 over to secure the upholstery thereto, lateral edges 248 of the upholstery and cushion assembly are positioned within channels 174 defined by shell 104 (FIG. 17). The lateral edge portions of the fabric are retained within channels 174 by an elongated, flexible extrusion 288. Extrusion 288 is dimensioned to be press-fitted into the channel 174 to firmly retain and clamp the fabric edges to the chair shell 104 within the channel. The extrusions 288 are formed with a configured channel 286 adapted to receive a barbed end 289 of a trim extrusion 290. Extrusion 290 covers extrusion 288 and channel 174 to provide a pleasing finished appearance to the rear surface of the chair back (FIG. 3). Once the lateral edges have been secured within the channel 174, top flap 182 is folded over to complete the rear appearance of the upholstery and shell combination.

Figure 4:
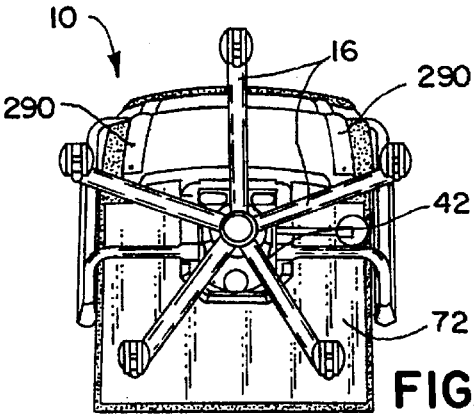
FIG. 4 is a bottom, plan view thereof.
Figure 6:
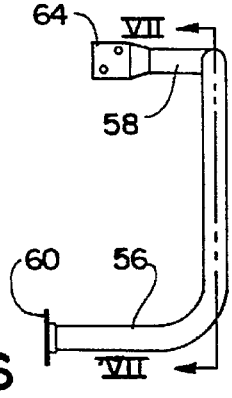
FIG. 6 is a front, elevational view of an arm incorporated in the present invention.
Figure 7:
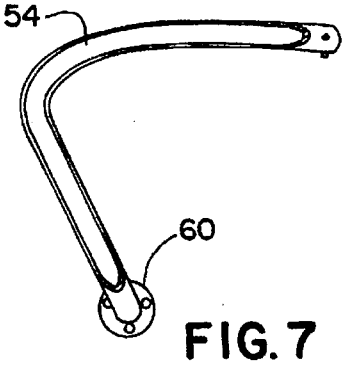
FIG. 7 is a cross-sectional view taken generally along line VII—VII of FIG. 6.

A forward edge 304 of the upholstery and cushion subassembly is folded over and secured to upholstery attachment flap 142 of seat shell 102. The upholstery material and foam is secured to flap 142 with adhesive or suitable staples. Flap 142 is then folded downwardly about its living hinge 144 until snaps 148 are received in snap apertures 150 defined by shell 102. This provides a finished appearance at the front edge of the seat shell. Lateral edges 308 of the fabric along the seat portion of the chair are similarly folded over against the undersurface of seat shell 102 and secured by suitable staples before flap 142 is secured. The undersurface of the chair is not normally visible in use. The undersurface may, however, be covered by a decorative shell 72, as seen in FIG. 4, to further complete the finished appearance of the chair.

The chair in accordance with the present invention offers significant advantages over prior chair constructions. Plastic shells may be employed for the back portion and seat portion. Problems heretofore experienced with molding such shells are, however, eliminated due to their fabrication as separate pieces and subsequent mechanical interconnection through a living hinge arrangement. Improved mold conditions are achieved and cost is reduced. The ride of the chair may be improved also by elimination of energy at the interface or zone between the back and seat portion of the chair. The shells are easily interconnected due to the tab and slot or socket arrangement with the tabs being readily captured by attachment of the seat to the base pan structure. The back shell may be fabricated in an aesthetically pleasing color. The attachment channels along the lateral sides of the back shell and the attachment flaps on the back shell and seat shell readily secure an upholstery and cushion subassembly to the shells. A finished edge is provided. Separate decorative outer shells or covers heretofore used to finish off the appearance of the chair and hide the cut or frayed fabric edges are eliminated. The separate tilt uprights for mounting the back portion of the chair on the base and the need for separate decorative covers are also eliminated through the use of the structural arms and tilt mechanism in accordance with the present invention. The resulting chair has a significantly reduced profile when compared to prior chairs incorporating a tilt mechanism with back uprights. The advantages of an adjustable chair including a tilt control for comfort are obtained at a significantly reduced cost from that heretofore available or achievable. The chair is relatively easily manufactured and assembled and should provide reliable operation in use.

In view of the above description, those of ordinary skill in the art may envision various modifications which would not depart from the inventive concepts disclosed herein. It is expressly intended, therefore, that the above description should be considered as only that of the preferred embodiment. The true spirit and scope of the present invention may be determined by reference to the appended claims.

The embodiments of the invention in which an exclusive property or privilege is claimed are defined as follows:

1. A chair, comprising:

a base;

a seat shell defining a rear edge, lateral edges and a front edge, said seat shell being fixed to said base;

a back shell having a top edge, lateral edges and a front edge;

at least one tab integral with said back shell; and at least one socket integral with said seat shell, said at least one socket being dimensioned to receive and retain said at least one tab in order to interconnect said shells, said at least one tab being clamped between said base and said seat shell to secure said back shell in place.

2. A chair as defined by claim 1 wherein said at least one tab is generally L-shaped in side elevation.

3. A chair as defined by claim 1 wherein said at least one tab is integral with a lower edge of said one of said back shell and said seat shell.

4. A chair as defined by claim 3 wherein said at least one tab is located at least partially between said base and said seat shell.

5. A chair as defined by claim 4 further including another tab and another socket, said another tab being integral with the lower edge of said back shell and said another socket being integral with said seat shell.

6. A chair as defined by claim 5 further comprising:

an arm having an end joined to said base and an end joined to said back shell.

7. A chair comprising:

a base;

a seat shell defining a rear edge, lateral edges and a front edge, said seat shell being fixed to said base;

a back shell having a top edge, lateral edges and a front edge;

at least two tabs integral with one of said seat shell and said back shell;

at least two sockets integral with the other of said seat shell and said back shell, said at least two sockets being dimensioned to receive and retain said at least two tabs in order to interconnect said shells, said at least two tabs each being generally L-shaped in side elevation and further being integral with a lower edge of said one of said back shell and said seat shell and still further being located at least partially between said base and said seat shell;

an arm having an end joined to said base and an end joined to said back shell; and tilt means on said base and engaging said arm for resiliently biasing said arm and said back shell to an upright position, said at least two tabs being joined to said back shell by an integral hinge.

8. A chair, comprising:

a base;

a molded seat shell attached to said base;

a tilt mechanism on said base;

a molded back shell operatively connected to said tilt mechanism for movement between upright and tilt positions;

a hinge comprising molded polymeric material integrally molded as part of one of said back shell and said seat shell and forming a living hinge configured to hingedly and releasably interlockingly interconnect said back shell to said seat shell; and a cushion assembly secured to said seat shell and said back shell.

9. A chair as defined by claim 8 wherein said hinge comprises:

one of said seat shell and said back shell defining at least one elongated tab joined to said one of said shells along a hinge line.

10. A chair as defined by claim 9 wherein the other of said shells defines at least one integral socket dimensioned to receive said elongated tab.

11. A chair as defined by claim 9 wherein said at least one tab is formed integral with a lower edge of said back shell.

12. A chair as defined by claim 11 wherein said seat shell includes a rear edge, said seat shell defining an aperture dimensioned to receive said at least one tab.

13. A chair as defined by claim 12 wherein said base engages said at least one tab and clamps said at least one tab against said seat shell.

14. A chair, comprising:

a base;

a seat shell attached to said base;

a tilt mechanism on said base;

a back shell operatively connected to said tilt mechanism for movement between upright and tilt positions;

mechanical hinge means integrally formed as part of one of said back shell and said seat shell for hingedly and releasably interconnecting said back shell to said seat shell;

a cushion assembly secured to said seat shell and said back shell; and said mechanical hinge means comprising one of said seat shell and said back shell defining at least one elongated tab joined to said one of said shells along a hinge line, the other of said shells defining at least one integral socket dimensioned to receive said elongated tab, said at least one tab being formed integral with a lower edge of said back shell, said seat shell including a rear edge, said seat shell defining an aperture dimensioned to receive said at least one tab, said base engaging said at least one tab and clamping said at least one tab against said seat shell, said seat shell including an integral strap which defines said aperture therewith.

15. A chair as defined by claim 14 wherein said at least one tab is generally L-shaped in side elevation, said strap engaging said at least one tab to prevent rearward movement thereof when said at least one tab is disposed within said aperture.

16. A chair as defined by claim 8 wherein said hinge comprises:

a pair of generally L-shaped elongated tabs integral with a lower edge of said back shell, each of said tabs being joined to said shell adjacent a lateral edge thereof by a living hinge.

17. A chair as defined by claim 16 wherein said hinge further comprises:

a pair of straps formed integral with said seat shell adjacent a rear edge thereof, said straps defining apertures dimensioned to receive said elongated tabs.

18. A chair, comprising:

a base;

a seat shell attached to said base;

a tilt mechanism on said base;

a back shell operatively connected to said tilt mechanism for movement between upright and tilt positions;

hinge means formed as part of said back shell and said seat shell for hingedly and releasably interconnecting said back shell to said seat shell;

a cushion assembly secured to said seat shell and said back shell;

said hinge means comprising a pair of generally L-shaped elongated tabs integral with a lower edge of said seat shell, each of said tabs being joined to said shell adjacent a lateral edge thereof by a living hinge, a pair of straps formed integral with said seat shell adjacent a rear edge thereof, said straps defining apertures dimensioned to receive said elongated tabs; and said seat shell being fixed to said base and said base interlockingly engaging said tabs to interferingly prevent inadvertent removal of said tabs from said apertures.

19. A chair, comprising:

a base;

a seat shell attached to said base;

a tilt mechanism on said base;

a back shell operatively connected to said tilt mechanism for movement between upright and tilt positions;

mechanical hinge means formed as part of said back shell and said seat shell for hingedly interconnecting said back shell to said seat shell;

a cushion assembly secured to said seat shell and said back shell; and said tilt mechanism including an elongated support member having a tilt end and a back end, and spring means on said base and operatively connected to said tilt end for resiliently biasing said support member to an upright position.

20. A chair as defined by claim 19 wherein said back shell is attached to said support member at said back end thereof.

21. A chair as defined by claim 20 further including another elongated support member having a tilt end operatively connected to said spring means and a back end attached to said back shell.

22. A chair as defined by claim 21 wherein said elongated support members are configured to define armrests.

23. A chair as defined by claim 18 wherein said back shell defines an upper edge having an upholstery attachment flap joined thereto, said cushion assembly including an upholstery portion folded over and joined to said flap, said flap being folded over against a rear surface of said back shell to secure said cushion assembly to said back shell and form a finished upholstery edge.

24. A chair as defined by claim 23 further including a fastener formed on said attachment flap for securing said flap to said rear surface of said shell.

25. A chair as defined by claim 24 wherein said fastener is generally T-shaped and said back shell defines a fastener aperture configured to receive and retain said fastener.

26. A chair as defined by claim 23 wherein said seat shell defines a front edge having a seat upholstery attachment flap joined thereto, said cushion assembly including another upholstery portion folded over said seat upholstery attachment flap of said seat shell and joined thereto, said flap being folded against and secured to an undersurface of said seat shell to attach said cushion assembly to said seat shell.

27. A chair as defined by claim 26 wherein a rear surface of said back shell defines a pair of elongated, outwardly open channels, said channels being spaced inwardly from lateral edges of said back shell, said cushion assembly including lateral edge portions disposed within said channels.

28. A chair as defined by claim 27 further including a pair of elongated, flexible members press-fitted into said channels to retain said lateral edge portions.

29. A chair as defined by claim 28 further comprising:

elongated trim strips joined to said flexible members and covering said channels.

30. A chair as defined by claim 29 wherein said hinge comprises:

a pair of generally L-shaped elongated tabs integral with a lower edge of said seat shell, each of said tabs being joined to said shell adjacent a lateral edge thereof by a living hinge.

31. A chair as defined by claim 30 wherein said hinge further comprises:

a pair of straps formed integral with said seat shell adjacent a rear edge thereof, said straps defining apertures dimensioned to receive said elongated tabs.

32. A chair as defined by claim 31 wherein said seat shell is fixed to said base and said base engages said tabs preventing removal of said tabs from said apertures.

33. A chair as defined by claim 32 wherein said tilt mechanism includes:

an elongated support member having a tilt end and a back end; and spring means on said base and operatively connected to said tilt end for resiliently biasing said support member to an upright position.

34. A chair as defined by claim 33 wherein said back shell is attached to said back end of said support member at said rear surface of said back shell.

35. A chair as defined by claim 34 further including another elongated support member having a tilt end operatively connected to said spring means and a back end attached to said back shell.

36. A chair as defined by claim 35 wherein said elongated support members are configured to define armrests.

37. An upholstered chair, comprising:

a base;

a shell mounted on said base, said shell defining an upholstery attachment member joined to the shell along an edge thereof, said shell having front and rear surfaces; and upholstery material having a portion folded over and secured to said attachment member, said material being on the front surface of said shell, said attachment member being folded against the rear surface to retain the material on said shell and to define a finished edge.

38. An upholstered chair as defined by claim 37 wherein said shell further defines an elongated channel opening through said rear surface and extending along a lateral edge of said shell.

39. An upholstered chair as defined by claim 38 wherein said upholstery material includes a lateral edge portion disposed in said channel and said chair further includes an elongated, flexible base extrusion press-fitted into said channel to retain said lateral edge portion of said upholstery.

40. An upholstered chair as defined by claim 39 wherein said base extrusion defines an elongated slot and said chair further includes an elongated trim member having an attachment portion disposed in said slot.

41. An upholstered chair as defined by claim 39 wherein said shell defines the back of said chair.

42. An upholstered chair as defined by claim 41 further including a seat shell on said base and joined to said shell defining said back of said chair.

43. An upholstered chair as defined by claim 42 wherein said seat shell includes a forward edge and said seat shell defines an integral attachment flap hinged to said forward edge, said upholstery material including a forward edge folded over and joined to said attachment flap, said attachment flap being folded against a bottom surface of said seat shell and attached thereto.

44. An upholstered chair as defined by claim 43 further including:

snap means on said attachment member for securing said attachment member to said shell which defines the back of said chair.

45. An upholstered chair as defined by claim 44 wherein said shell defining the back of the chair further defines another channel opening through said rear surface, said channels each extending along a lateral edge of said shell.

46. An upholstered chair as defined by claim 45 further including another elongated, flexible base extrusion press-fitted into said another channel and retaining another upholstery portion therein.

47. An upholstered chair as defined by claim 46 further including another trim strip secured to said another elongated, flexible base extrusion and covering said another channel.

48. A chair, comprising:

a base;

a seat shell defining a rear edge, lateral edges and a front edge, said seat shell being fixed to said base;

a back shell having a top edge, lateral edges and a front edge;

at least one tab integral with one of said seat shell and said back shell;

at least one socket integral with the other of said seat shell and said back shell, said at least one socket dimensioned to receive and retain said at least one tab in order to interconnect said shells; and said at least one tab being integral with a lower edge of said back shell and said seat shell and further being located at least partially between said base and said seat shell and engaged with said base and said seat shell to assist in securing said back shell relative to said base.

49. A chair as defined by claim 48 wherein said seat shell is fixed to said base and said base interlockingly engages said at least one tab in a manner causing interference that prevents removal of said at least one tab from said at least one socket.

50. A chair as defined by claim 48 including an arm having an end joined to said base and an end joined to said back shell.

51. A chair as defined by claim 50 including tilt means on said base and engaging said arm for resiliently biasing said arm and said back shell to an upright position, said at least one tab being joined to said back shell by an integral hinge.

52. In an upholstered chair having a shell structure and upholstering fabric covering the shell structure, an improvement comprising:

an upholstery attachment member joined to the shell structure along an edge thereof, said attachment member being adapted to fold against a surface of the shell structure and further being adapted to be secured to said shell structure in a folded condition with the upholstery fabric disposed therebetween to provide a finished upholstered edge.

53. An improvement as defined by claim 52 wherein said attachment member includes a fastener for securely engaging said shell structure.

54. An improvement as defined by claim 53 wherein said fastener is integrally formed in said attachment member.

55. An improvement as defined by claim 54 wherein said shell structure includes integrally formed fastener receiving structure for receiving said fastener on said attachment member.

56. An improvement as defined by claim 55 wherein said attachment member includes a living hinge connecting said attachment member to said shell structure.

57. An improvement as defined by claim 52 wherein said fastener comprises a snap fastener configured to engage apertures in said shell structure.

58. An improvement as defined by claim 52 wherein said attachment member includes a living hinge connecting said attachment member to said shell structure.

59. An improvement as defined by claim 52 including a channel defined in the shell structure for receiving an edge of the upholstery fabric, and further including an extrusion for engaging and retaining the edge of the upholstery fabric in the channel.

60. A chair, comprising:

a base;

a seat shell comprising a molded structural plastic defining a rear edge, lateral edges and a front edge, said seat shell being fixed to said base;

a back shell comprising a molded structural plastic having a top edge, lateral edges and a front edge;

at least one tab molded integrally with one of said seat shell and said back shell;

at least one socket molded integrally with the other of said seat shell and said back shell, said at least one socket being dimensioned to receive and retain said at least one tab in order to interconnect said shells; and said at least one tab being at least partially between said base and said seat shell and engaging with said base and said seat shell to assist in securing said back shell relative to said base.

61. A chair as defined by claim 60 wherein said at least one tab is integral with a lower edge of said one of said back shell and said seat shell.

62. A chair as defined by claim 61 further including another tab and another socket, said another tab being integral with one lower edge of said back shell and said another socket being integral with said seat shell.

63. A chair as defined by claim 62 wherein said at least one tab and said another tab are located at opposite sides of said one of said seat shell and said back shell.

64. A chair as defined by claim 63 wherein said back shell includes channels extending parallel lateral edges of said back shell, said at least one tab and said another tab being located in a position laterally and exteriorly of said channels on said back shell.

65. A chair, comprising:

a base;

a seat shell comprising a molded structural plastic defining a rear edge, lateral edges and a front edge, said seat shell being fixed to said base;

a back shell comprising a molded structural plastic having a top edge, lateral edges and a front edge;

at least one tab;

a hinge mechanism connecting said at least one tab to one of said seat shell and said back shell; and at least one socket molded integrally with the other of said seat shell and said back shell, said at least one socket dimensioned to receive and retain said at least one tab in order to interconnect said shells, said hinge mechanism providing relative movement between said back shell and said seat shell upon the interconnection of said shells.

66. A chair as defined by claim 65 wherein said hinge mechanism comprises an integral flexible section of material forming a living hinge.

67. A chair as defined by claim 66 wherein said at least one tab is integral with a lower edge of said back shell.

68. A chair as defined by claim 67 further including another tab and another socket, said another tab being integral with a lower edge of said back shell and said another socket being integral with said seat shell.

69. A chair as defined by claim 65 wherein said hinge includes an integral hinge connecting said at least one tab to said one shell.

* * * * *

UNITED STATES PATENT AND TRADEMARK OFFICE

CERTIFICATE OF CORRECTION

PATENT NO. : 5,630,643

DATED : May 20, 1997

INVENTOR(S) : Scholten, et al

It is certified that error appears in the above-indentified patent and that said Letters Patent is hereby corrected as shown below:

On the title page, insert item [73] Assignee: ---SteelCase Inc. Grand Rapids Michigan--.

Signed and Sealed this

Twenty-eighth Day of October, 1997

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,630,643
DATED : May 20, 1997
INVENTOR(S) : Scholten et al.

It is certified that error appears in the above-identified patent and that said Letters Patent is hereby corrected as shown below:

On the title page, insert item [73] Assignee: --Steelcase Inc., Grand Rapids, Michigan--.

This certificate supersedes Certificate of Correction issued October 28, 1997.

Signed and Sealed this

Twenty-seventh Day of January, 1998

*Attest:*

*Attesting Officer*

BRUCE LEHMAN

*Commissioner of Patents and Trademarks*